US011028463B2

(12) United States Patent
Weber

(10) Patent No.: US 11,028,463 B2
(45) Date of Patent: Jun. 8, 2021

(54) COPPER ALLOY CONTAINING TIN, METHOD FOR PRODUCING SAME, AND USE OF SAME

(71) Applicant: WIELAND-WERKE AG, Ulm (DE)

(72) Inventor: Kai Weber, Bellenberg (DE)

(73) Assignee: WIELAND-WERKE AG, Ulm (DE)

( * ) Notice: Subject to any disclaimer, the term of this patent is extended or adjusted under 35 U.S.C. 154(b) by 277 days.

(21) Appl. No.: 16/078,950

(22) PCT Filed: Feb. 10, 2017

(86) PCT No.: PCT/EP2017/000190

§ 371 (c)(1),
(2) Date: Aug. 22, 2018

(87) PCT Pub. No.: WO2017/148569

PCT Pub. Date: Sep. 8, 2017

(65) Prior Publication Data

US 2019/0062875 A1 Feb. 28, 2019
US 2020/0181738 A9 Jun. 11, 2020

(30) Foreign Application Priority Data

Mar. 3, 2016 (DE) ..... 10 2016 002 618.9

(51) Int. Cl.
*C22C 9/02* (2006.01)
*C22F 1/08* (2006.01)
*B22D 21/02* (2006.01)

(52) U.S. Cl.
CPC ..... *C22C 9/02* (2013.01); *B22D 21/025* (2013.01); *C22F 1/08* (2013.01)

(58) Field of Classification Search
CPC ..... C22C 9/02; B22D 21/025; C22F 1/08
See application file for complete search history.

(56) References Cited

U.S. PATENT DOCUMENTS 2,128,955 A 9/1938 Montgomery
3,392,017 A * 7/1968 Quaas ..... B23K 35/302 420/570

(Continued)

FOREIGN PATENT DOCUMENTS

DE 581 507 C 7/1933
DE 704 398 C 3/1941

(Continued)

OTHER PUBLICATIONS

International Search Report issued in Application No. PCT/EP2017/000190 with English translation, dated May 22, 2017 (5 pages).

(Continued)

*Primary Examiner* — Anthony J Zimmer
*Assistant Examiner* — Ricardo D Morales
(74) *Attorney, Agent, or Firm* — Flynn Thiel, P.C.

(57) ABSTRACT

The invention relates to a high-strength as-cast copper alloy containing tin, with excellent hot-workability and cold-workability properties, high resistance to abrasive wear, adhesive wear and fretting wear, and improved corrosion resistance and stress relaxation resistance, consisting (in wt. %) of: 4.0 to 23.0% Sn, 0.05 to 2.0% Si, 0.005 to 0.6 B, 0.001 to 0.08% P, optionally up to a maximum of 2.0% Zn, optionally up to a maximum of 0.6% Fe, optionally up to a maximum of 0.5% Mg, optionally up to a maximum of 0.25% Pb, with the remainder being copper and inevitable impurities, characterised in that the ratio of Si/B of the element content of the elements silicon and boron lies between 0.3 and 10. The invention also relates to a casting variant and a further-processed variant of the tin-containing copper alloy, a production method, and the use of the alloy.

18 Claims, 3 Drawing Sheets

(56) References Cited

U.S. PATENT DOCUMENTS

Figure 1:
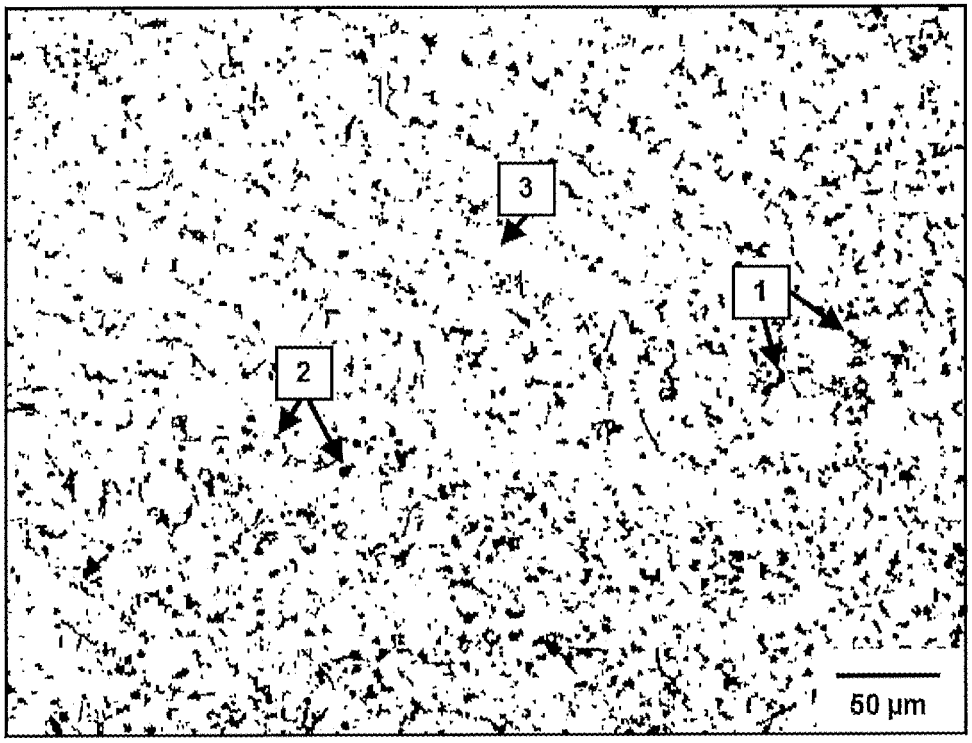

| | | | |
|---|---|---|---|
| 6,136,103 | A | 10/2000 | Boegel et al. |
| 7,368,824 | B2 | 5/2008 | Hosseini et al. |
| 9,162,423 | B2 | 10/2015 | Boeschen et al. |
| 2012/0321909 | A1 | 12/2012 | Boeschen et al. |

FOREIGN PATENT DOCUMENTS

| | | | |
|---|---|---|---|
| DE | 864 024 | C | 1/1953 |
| DE | 24 40 010 | B2 | 3/1975 |
| DE | 25 36 166 | A1 | 3/1977 |
| DE | 36 27 282 | A1 | 2/1988 |
| DE | 39 32 536 | C1 | 8/1990 |
| DE | 41 26 079 | C2 | 2/1993 |
| DE | 197 56 815 | C2 | 7/1999 |
| DE | 102 08 635 | B4 | 9/2003 |
| DE | 10 2007 010 266 | B3 | 7/2008 |
| DE | 10 2012 105 089 | A1 | 12/2012 |
| EP | 2 100 981 | A2 | 9/2009 |
| JP | 63045342 | A | 2/1988 |

OTHER PUBLICATIONS

Written Opinion of International Searching Authority issued in Application No. PCT/EP2017/000190 dated May 22, 2017 (7 pages).

Office Action of German Patent Office issued in Application No. 10 2016 002 618.9 dated Jul. 3, 2017 (6 pages).

* cited by examiner

COPPER ALLOY CONTAINING TIN, METHOD FOR PRODUCING SAME, AND USE OF SAME

The present invention relates to a tin-containing copper alloy having an excellent hot formability and cold formability, high resistance to abrasive wear, adhesive wear and fretting wear and an improved corrosion resistance and stress relaxation resistance, to a process for production thereof, and to the use thereof.

Due to the tin alloy component, copper-tin alloys feature high-strength and hardness. Moreover, copper-tin alloys are considered to be corrosion-resistant and seawater-resistant.

This group of materials has a high resistance to abrasive wear. Moreover, the copper-tin alloys ensure good sliding properties and a high fatigue endurance limit, which results in their excellent suitability for sliding elements and sliding surfaces in engine and vehicle construction and in mechanical engineering in general. Frequently, an addition of lead is added to the copper-tin alloys for slide bearing applications for improvement of the dry-running operation properties and machinability.

Copper-tin alloys find wide use in the electronics and telecommunications industry. They have an electrical conductivity that is frequently still adequate, and good to very good spring properties. The adjustment of the spring properties requires excellent cold formability of the materials.

In the music industry, percussion instruments are preferably produced from copper-tin alloys due to their exceptional sound properties. The production of cymbals requires very good hot formability of the materials. In particular, copper-tin alloys with 8% and 20% by weight of tin are in wide use.

In the first production step, casting, the copper-tin materials have a particularly high tendency to absorb gas with subsequent pore formation and to show segregation phenomena due to their broad solidification interval. The Sn-rich segregations can be eliminated only to a limited degree by a homogenization annealing operation that follows the casting process. The propensity of the copper-tin alloys to form pores and segregations increases with a rising Sn content.

The element phosphorus is added to the copper-tin alloys in order to sufficiently deoxidize the melt. However, phosphorus additionally extends the solidification interval of copper-tin alloys, which results in an elevated proneness to pores and segregations in this material group.

For this reason, documents DE 41 26 079 C2 and DE 197 56 815 C2 favor thin strip casting for the primary forming of copper-tin alloys, as well as the process of spray compaction. In this way, by means of the exact adjustment of the solidification rate of the melt, it is possible to produce a low-segregation preform having a fine and homogeneous distribution of the Sn-rich δ phase for the subsequent hot forming operation.

In principle, document DE 581 507 A provides an indication of how pure copper-tin alloys having 14% to 32% by weight of Sn and copper- and tin-present alloys having 10% to 32% by weight of Sn can be rendered hot-formable. What is proposed is heating of the alloy to a temperature of 820 to 970° C. with subsequent very slow cooling to 520° C. The duration of this cooling should be at least 5 hours. Cooling to room temperature at a normal cooling rate may be followed by the hot forming of the material at 720 to 920° C.

Document DE 704 398 A describes a process for producing shaped pieces from copper-tin alloys containing 6% to 14% by weight of Sn, more than 0.1% by weight of P, preferably 0.2% to 0.4% by weight of P, which may be replaced by silicon, boron or beryllium. Preferably, the copper-tin alloy contains about 91.2% by weight of Cu, about 8.5% by weight of Sn and about 0.3% P. Before final processing by cold forming or hot forming, the castings are accordingly homogenized at a temperature below 700° C. until the dissolution of the tin- and phosphorus-enriched eutectoids.

The significance of crystallization seeds for the formation of a fine-grain microstructure having a low proportion of Sn-rich segregations for the hot formability of Sn-containing copper alloys is emphasized in documents U.S. Pat. No. 2,128,955 A and DE 25 36 166 A1. Phosphidic compounds constitute the crystallization seeds, which achieves tempering of the cast structure and lowers the formation of low-melting copper-phosphorus or copper-phosphorus-tin phases to a minimum degree. This is said to give a crucial improvement in hot formability.

As a result of rising operating temperatures and pressures in modern engines, machines, installations and aggregates, a wide variety of different mechanisms of damage to the individual system elements occurs. Thus, there is an ever greater necessity, especially in the case of the design of sliding elements and plug connectors from the point of view of materials and construction, to take account not only of the types of sliding wear but also of the mechanism of damage by oscillating friction wear.

Oscillating friction wear, also called fretting, is a kind of friction wear that occurs between oscillating contact faces. In addition to the geometry and/or volume wear of the components, the reaction with the surrounding medium results in friction corrosion. The damage to the material can distinctly lower local strength in the wear zone, especially fatigue strength. Fatigue cracks can travel from the damaged component surface, and these lead to fatigue fracture/fatigue failure. Under friction corrosion, the fatigue strength of a component can drop well below the fatigue index of the material.

In one sense, the mechanism of oscillating friction wear differs considerably from the types of sliding wear with respect to movement. More particularly, the effects of corrosion are particularly marked in the case of oscillating friction wear.

Document DE 10 2012 105 089 A1 describes the consequences of damage caused by oscillating friction wear of slide bearings. The operation of indenting the slide bearing into the bearing seat creates a high stress on the slide bearing, which is even further increased by the thermal expansions and the dynamic shaft loads in modern engines. The changes in geometry of the slide bearing as a result of the excessive increase in stress enable micro-movements of the slide bearing relative to the bearing seat. The cyclical relative movements with a low oscillation width at the contact faces between the bearing and bearing seat lead to oscillation friction wear/friction corrosion/fretting of the backing of the slide bearing. The consequence is the initiation of cracks and ultimately the friction fatigue failure of the slide bearing.

In engines and machines, electrical plug connectors are frequently disposed in an environment in which they are subjected to mechanical oscillating vibrations. If the elements of a connection arrangement are present in different assemblies that perform movements relative to one another as a result of mechanical stresses, the result can be corresponding relative movement of the connection elements. These relative movements lead to oscillating friction wear and to friction corrosion of the contact zone of the plug connectors. Microcracks form in this contact zone, which greatly reduces the fatigue resistance of the plug connector material. Failure of the plug connector through fatigue failure can be the consequence. Moreover, due to the friction corrosion, there is a rise in the contact resistance.

To reduce these forms of damage, document DE 10 2007 010 266 B3 proposes equipping every wire connected to the plug connector with a means of strain relief by construction means, as a result of which the movements of the wire can no longer affect the plug connector.

Document DE 39 32 536 C1 contains a method by which the friction corrosion characteristics of plug connectors can be improved from a material point of view. For instance, a contact material composed of a silver, palladium or palladium/silver alloy having a content of 20% to 50% by weight of tin, indium and/or antimony has been applied to a carrier made of bronze, for example. The silver and/or palladium content ensures corrosion resistance. The oxides of tin, of indium and/or of antimony increase wear resistance. Thus, the consequences of the friction corrosion can be countered.

A crucial factor for sufficient resistance to oscillating friction wear/friction corrosion is accordingly a combination of the material properties of wear resistance, ductility and corrosion resistance.

Document DE 36 27 282 A1 describes the mechanisms of the crystallization of a metallic melt. If only a small number of crystallization seeds is present, or if only a small number of seeds is formed in the melt, the consequence is a coarse-grain, high-segregation and often dendritic solidified microstructure. A copper alloy having 0.1% to 25% by weight of calcium and 0.1% to 15% by weight of boron is named, which can be added to the melt of copper materials for grain refinement. In this way, the addition of crystallizers generates a homogeneous and fine-grain solidified microstructure in copper alloys.

Alloying with metalloids, for example boron, silicon and phosphorus, achieves the lowering of the relatively high base melt temperature, which is important from a processing point of view. In the coating and high-temperature materials of the Ni—Si—B and Ni—Cr—Si—B systems, the boron and silicon alloy elements are considered to be particularly responsible for the significant lowering of the melting temperature of nickel-base hard alloys, which makes it possible to use them as spontaneously flowing nickel-base hard alloys.

The lowering of the base melt temperature by the inclusion of boron in the alloy is utilized for copper-tin materials that find use as a deposit welding material. For instance, document U.S. Pat. No. 3,392,017 A discloses an alloy having up to 0.4% by weight of Si, 0.02% to 0.5% by weight of B, 0.1% to 1.0% by weight of P, 4% to 25% by weight of Sn, and a balance of Cu. The addition of boron, and a very high content of phosphorus of not less than 0.1% by weight, improves the spontaneous flow properties of the deposit welding alloy and the wettability of the substrate surface and makes it unnecessary to use additional flux. A particularly high P content of 0.2% to 0.6% by weight is stipulated here, with a Si content of the alloy of 0.05% to 0.15% by weight. This underlines the primary requirement for the spontaneous flow properties of the material. With this high P content, however, the possibilities of hot formability of the alloy are highly restricted.

Document DE 102 08 635 B4 describes the processes in a diffusion soldering site in which there are intermetallic phases. By means of diffusion soldering, the intention is to bond parts having a different coefficient of thermal expansion to one another. In the event of thermomechanical stresses on this soldering site or in the soldering operation itself, large stresses occur on the interfaces, which can lead to cracks particularly in the environment of the intermetallic phases. A remedy proposed is the mixing of the soldering components with particles that bring about balancing of the different coefficients of expansion of the joining partners. For instance, particles of boron silicates or phosphorus silicates, due to their advantageous coefficients of thermal expansion, can minimize thermomechanical stress in the solder bond. Moreover, spreading of the cracks already induced is hindered by these particles.

Laid-open specification DE 24 40 010 B2 particularly emphasizes the influence of the element boron on the electrical conductivity of a cast silicon alloy having 0.1% to 2.0% by weight of boron and 4% to 14% by weight of iron. In this Si-based alloy, a high-melting Si—B phase precipitates out, which is referred to as silicon boride.

The silicon borides, which are usually present in the $SiB_3$, $SiB_4$, $SiB_6$ and/or $SiB_n$ modifications that are determined by the boron content, differ significantly from silicon in their properties. These silicon borides have metallic character, and are therefore electrically conductive. They have exceptionally high thermal stability and oxidation stability. The $SiB_6$ modification, preferably used for sintered products due to its very high hardness and its high abrasive wear resistance, is used in ceramics production and ceramics processing, for example.

An object of the invention is to provide a copper-tin alloy that has an excellent hot formability over the entire tin content range.

For hot forming, it is possible to use a precursor material that has been produced without the absolute necessity of the performance of spray compaction or of thin belt casting by means of conventional casting methods.

The copper-tin alloy should be free of gas pores, shrinkage pores and stress cracks, and should be characterized by a microstructure having homogeneous distribution of the Sn-rich δ phase which is present according to the Sn content of the alloy. The cast state of the copper-tin alloy need not necessarily first be homogenized by means of a suitable annealing treatment in order to be able to establish adequate hot formability. Even the casting material should feature a high strength, a high hardness, and a high corrosion resistance. By means of further processing comprising an annealing operation or a hot forming and/or cold forming operation with at least one annealing operation, a fine-grain microstructure with a high strength, a high hardness, high stress relaxation resistance and corrosion resistance, a high electrical conductivity, and with a high degree of complex wear resistance should be established.

The invention includes a high-strength tin-containing copper alloy having an excellent hot formability and cold formability, high resistance to abrasive wear, adhesive wear and fretting wear and improved corrosion resistance and stress relaxation resistance, consisting of (in % by weight):

4.0% to 23.0% Sn,
0.05% to 2.0% Si,
0.005% to 0.6% B,
0.001% to 0.08% P,
with or without up to a maximum of 2.0% Zn,
with or without up to a maximum of 0.6% Fe,
with or without up to a maximum of 0.5% Mg,
with or without up to a maximum of 0.25% Pb,
the balance being copper and unavoidable impurities,
wherein the Si/B ratio of the element contents of the elements silicon and boron is between 0.3 and 10.

In addition, the invention includes a high-strength tin-containing copper alloy having an excellent hot formability and cold formability, high resistance to abrasive wear, adhesive wear and fretting wear and improved corrosion resistance and stress relaxation resistance, consisting of (in % by weight):

4.0% to 23.0% Sn,
0.05% to 2.0% Si,
0.005% to 0.6% B,
0.001% to 0.08% P,
with or without up to a maximum of 2.0% Zn,
with or without up to a maximum of 0.6% Fe,
with or without up to a maximum of 0.5% Mg,
with or without up to a maximum of 0.25% Pb,
the balance being copper and unavoidable impurities, characterized in that the Si/B ratio of the element contents of the elements silicon and boron is between 0.3 and 10;

after casting, the following microstructure constituents are present in the alloy:

a) 1% to 98% by volume of Sn-rich δ phase, b) 1% to 20% by volume of Si- and B-containing phases, c) balance: solid solution of copper, consisting of low-tin a phase, wherein the Si-containing and B-containing phases are ensheathed by tin and/or the Sn-rich δ phase;

in the casting, the Si-containing and B-containing phases which are in the form of silicon borides constitute seeds for homogeneous crystallization during the solidification/cooling of the melt, such that the Sn-rich δ phase is distributed homogeneously in the microstructure in the form of islands and/or a network;

the Si-containing and B-containing phases which are in the form of boron silicates and/or boron phosphorus silicates, together with phosphorus silicates, assume the role of a wear-protective and/or corrosion-protective coating on semifinished products and components of the alloy.

As a result of the homogeneous distribution of the Sn-rich δ phase in an island form and/or in a network form, the microstructure is free of Sn-rich segregations. Sn-rich segregations of this kind are understood to mean accumulations of the δ phase in the cast microstructure that take the form of what are called inverse block segregations and/or particle boundary segregations which cause damage to the microstructure in the form of cracks under thermal and/or mechanical stress on the casting, which can lead to fracture. The microstructure after casting is still free of gas pores, shrinkage pores and stress cracks.

In this variant, the alloy is in the cast state.

In addition, the invention includes a high-strength tin-containing copper alloy having an excellent hot formability and cold formability, high resistance to abrasive wear, adhesive wear and fretting wear and improved corrosion resistance and stress relaxation resistance, consisting of (in % by weight):

4.0% to 23.0% Sn,
0.05% to 2.0% Si,
0.005% to 0.6% B,
0.001% to 0.08% P,
with or without up to a maximum of 2.0% Zn,
with or without up to a maximum of 0.6% Fe,
with or without up to a maximum of 0.5% Mg,
with or without up to a maximum of 0.25% Pb,
the balance being copper and unavoidable impurities, characterized in that the Si/B ratio of the element contents of the elements silicon and boron is between 0.3 and 10;

after a further processing of the alloy by at least one annealing operation or by at least one hot forming operation and/or cold forming operation in addition to at least one annealing operation, the following microstructure constituents are present in the alloy:

a) up to 75% by volume of Sn-rich δ phase, b) 1% up to 20% by volume of Si-containing and B-containing phases, c) balance: solid solution of copper, consisting of low-tin a phase, wherein the Si-containing and B-containing phases are ensheathed by tin and/or the Sn-rich δ phase;

the Si-containing and B-containing phases, which are in the form of silicon borides, constitute seeds for static and dynamic recrystallization of the microstructure during the further processing of the alloy, which enables the establishment of a homogeneous and fine-grain microstructure;

the Si-containing and B-containing phases which are in the form of boron silicates and/or boron phosphorus silicates, together with phosphorus silicates, assume the role of a wear-protective and/or corrosion-protective coating on semifinished products and components of the alloy.

Preferably, the Sn-rich δ phase is at least 1% by volume.

In the further-processed state, the Sn-rich δ phase is distributed homogeneously in the microstructure in the form of islands, and/or a network, and/or extended lines. In this variant, the alloy is in the further-processed state.

In the case of the alloy variants, the invention proceeds from the consideration that a tin-containing copper alloy in the cast state and also in the further-processed state having Si-containing and B-containing phases is provided, which can be produced by means of a sandcasting, shell mold casting, precision casting, full mold casting, pressure die-casting, permanent mold casting process, or with the aid of a continuous or semicontinuous strand casting process. The use of primary forming techniques, which are costly and inconvenient from a processing point of view, is possible but is not an absolute necessity for the production of the tin-containing copper alloy of the invention. For example, it is possible to dispense with the use of spray compaction. The cast shapes of the tin-containing copper alloy of the invention can be hot-formed over the entire Sn content range, for example by hot rolling, extrusion or forging. Thus, the processing-related restrictions that have existed to date in the production of semifinished products and components from copper-tin alloys and that have led to the division of this group of materials into Cu—Sn kneading alloys and Cu—Sn casting alloys are largely eliminated.

With an increasing Sn content of the alloy, the matrix of the microstructure of the tin-containing copper alloy in the cast state, consists of increasing proportions of δ phase (Sn-rich) in otherwise a phase (Sn-deficient), depending on the casting process.

With the rising Sn content of the alloy of the invention, there is not only an increase in the proportion of the δ phase in the microstructure, but also a change in the form of the arrangement of the δ phase in the microstructure. Thus, it has been found that, within the Sn content range from 4.0% to 9.0% by weight, the δ phase is distributed homogeneously in the microstructure with up to 40% by volume predominantly in an island form. If the Sn content of the alloy is between 9.0% and 13.0% by weight, the island form of the δ phase present at up to 60% by volume in the microstructure is converted to a network form. This δ network is likewise distributed very homogeneously in the microstructure of the alloy. In the Sn content range from 13.0% to 17.0% by weight, the δ phase is present with up to 80% by volume virtually exclusively in the form of a homogeneous network in the microstructure. In the case of a Sn content of the alloy from 17.0% to 23.0% by weight, the proportion of the microstructure of the δ phase arranged in the form of a dense network in the microstructure is up to 98% by volume.

By means of the combined content of boron, silicon and phosphorus, various operations are activated in the melt of the alloy of the invention, which crucially alter the solidification characteristics thereof by comparison with the conventional copper-tin and copper-tin-phosphorus alloys.

The elements boron, silicon and phosphorus assume a deoxidizing function in the melt. Thus, the formation of tin oxides in the tin-containing copper alloy is counteracted. The addition of boron and silicon makes it possible to lower the content of phosphorus without lowering the intensity of the deoxidation of the melt. Using this measure, it is possible to suppress the adverse effects of adequate deoxidation of the melt by means of a phosphorus addition. Thus, a high P content would additionally widen the solidification interval of the tin-containing copper alloy which is already very large in any case, which would result in an increase in the proneness of this material type to pores and segregations. Moreover, the result would be the increased formation of the copper-phosphorus phase. This type of phase is considered to be a cause of the hot brittleness of the tin-containing copper alloys. The adverse effects of the addition of phosphorus are reduced by the limitation of the P content in the alloy of the invention to the range from 0.001% to 0.08% by weight.

The elements boron and silicon are of particular significance in the tin-containing copper alloy of the invention. Even in the melt, the phases of the Si—B systems precipitate out. These Si—B phases, named silicon borides, may be present in the $SiB_3$, $SiB_4$, $SiB_6$ and $SiB_n$. The symbol "n" in the latter form is based on the fact that boron has a high solubility in the silicon lattice.

The Si-containing and B-containing phases which take the form of silicon borides are referred to hereinafter as hard particles. In the melt of the alloy of the invention, they assume the function of crystallization seeds during the solidification and cooling. As a result, it is no longer necessary to supply the melt with what are called extraneous seeds, and the homogeneous distribution of which in the melt can be assured only to an inadequate degree.

The lowering of the base melt temperature particularly by the element boron and the existence of the hard particles that act as crystallization seeds lead to a crucial reduction in the size of the solidification interval of the alloy of the invention. As a result, the cast state of the invention, according to the Sn content, has a very homogeneous microstructure with a fine distribution of the δ phase in the form of homogeneously and densely arranged islands and/or in the form of a homogeneously dense network. Accumulations of the Sn-rich δ phase that take the form of what are called inverse block segregations and/or of grain boundary segregations cannot be observed in the cast microstructure of the invention.

In the melt of the alloy of the invention, the elements boron, silicon and phosphorus bring about a reduction of the metal oxides. The elements are themselves oxidized here and rise up to the surface of the castings, where, in the form of boron silicates, phosphorus silicates and/or boron phosphorus silicates, they form a protective layer that protects the castings from the absorption of gas. Exceptionally smooth surfaces of the castings of the alloy of the invention have been found which indicate the formation of such a protective layer. The microstructure of the cast state of the invention was also free of gas pores over the entire cross section of the castings.

A basic concept of the invention is the application of the effect of boron silicates and phosphorus silicates with regard to the balancing of the different coefficients of thermal expansion of the joining partners in diffusion soldering to the processes in the casting, hot forming and thermal treatment of the copper-tin materials. The broad solidification interval of these alloys results in large mechanical stresses between the Sn-deficient and Sn-rich structure regions that crystallize in an offset manner, which can lead to cracks and pores. In addition, these damage features can also occur in the course of the hot forming and high-temperature annealing operations on the copper-tin alloys due to the different hot forming characteristics and the different coefficients of thermal expansion of the Sn-deficient and Sn-rich microstructure constituents.

The combined addition of boron, silicon and phosphorus to the tin-containing copper alloy of the invention results first in a homogeneous microstructure having a fine distribution of the microstructure constituents with different Sn content by means of the effect of the hard particles as crystallization seeds during the solidification of the melt. In addition to the hard particles, the boron silicates, phosphorus silicates and/or boron phosphorus silicates that form during the solidification of the melt, assure the necessary balancing of the coefficients of thermal expansion of the Sn-deficient and Sn-rich phases. In this way, the formation of pores and stress cracks between the phases having a different Sn content is prevented.

Alternatively, the alloy of the invention can be subjected to further processing by annealing, or by a hot forming and/or cold forming operation as well as at least one annealing operation.

The effect of the hard particles as crystallization seeds which, together with the boron silicates, phosphorus silicates and/or boron phosphorus silicates, bring about the balancing of the coefficients of thermal expansion of the Sn-deficient and Sn-rich phases, was also observed during the operation of hot forming of the tin-containing copper alloy of the invention. In the course of hot forming, the hard particles serve as seeds for dynamic recrystallization. For this reason, the hard particles are considered to be responsible for the fact that the dynamic recrystallization takes place in a favored manner in the hot forming of the alloy of the invention. This results in a further increase in the homogeneity and fine-grain structure of the microstructure.

As with casting, an exceptionally smooth surface of the parts was also detected after the hot forming of the castings. This observation indicates the formation of boron silicates, phosphorus silicates and/or boron phosphorus silicates, which takes place in the material during the hot forming. The silicates and hard particles result in balancing of the different coefficients of thermal expansion of the Sn-deficient and Sn-rich constituents during the hot forming as well. Thus, the microstructure was free of cracks and pores after the hot forming operation as well, as after the casting operation.

The role of the hard particles as seeds for the static recrystallization was found during the annealing treatment after a cold forming operation. The major function of the hard particles as seeds for static recrystallization was manifested in the lowering of the necessary recrystallization temperature that had become possible, which additionally facilitates the establishment of a fine-grain microstructure of the alloy of the invention.

As a result, during the further processing of the alloy of the invention, higher degrees of cold forming are enabled, by means of which it is possible to establish particularly high values for tensile strength $R_m$, yield point $R_{p0.2}$ and hardness. In particular, the level of the parameter $R_{p0.2}$ is important for the sliding elements and guide elements in internal combustion engines, valves, turbochargers, gears, exhaust gas aftertreatment systems, lever systems, braking systems and joint systems, hydraulic aggregates, or in machines and installations in mechanical engineering in general. In addition, a high value of $R_{p0.2}$ is a prerequisite for the necessary spring properties of plug connectors in electronics and electrical engineering.

The Sn content of the invention varies within the limits between 4.0% and 23.0% by weight. A tin content below 4.0% by weight would result in excessively low strength values and hardness values. Moreover, the running properties under sliding stress would be inadequate. The resistance of the alloy to abrasive and adhesive wear would not meet the requirements. In the case of a Sn content exceeding 23.0% by weight, there would be a rapid deterioration in the ductility properties of the alloy of the invention which would lower the dynamic durability of the components made from the material.

As a result of the precipitation of the hard particles, the alloy of the invention has a hard phase component which, due to the high hardness of the silicon borides, contributes to an improvement in the material resistance to abrasive wear. Moreover, the proportion of hard particles results in an improved resistance to adhesive wear since these phases show a low tendency to wear with a metallic counterpart in the event of sliding stress. They thus serve as an important wear substrate in the tin-containing copper alloy of the invention. In addition, the hard particles increase the heat resistance and stress relaxation resistance of components of the invention. This constitutes an important prerequisite for the use of the alloy of the invention, especially for sliding elements and for components, wire elements, guide elements and connection elements in electronics/electrical engineering.

The formation of boron silicates, phosphorus silicates and/or boron phosphorus silicates in the alloy of the invention leads not only to a significant reduction in the pores and cracks in the microstructure. These silicate phases also assume the role of a wear-protective and/or corrosion-protective coating on the components.

Thus, the alloy of the invention ensures a combination of the properties of wear resistance and corrosion resistance. This combination of properties leads to a high resistance, as required, against the mechanisms of friction wear and to a high material resistance against friction corrosion. In this way, the invention is of excellent suitability for use as a sliding element and plug connectors since it has a high degree of resistance to sliding wear and oscillating friction wear, called fretting.

The effect of the hard particles as crystallization seeds and recrystallization seeds, as wear substrates and the action of the silicate phases for the purpose of corrosion protection can only achieve a degree of industrial significance in the alloy of the invention when the silicon content is at least 0.05% by weight and the boron content at least 0.005% by weight. If, by contrast, the Si content exceeds 2.0% by weight and/or the B content 0.6% by weight, this leads to a deterioration in the casting characteristics. The excessively high content of hard particles would make the melt more viscous. Moreover, the result would be reduced ductility properties of the alloy of the invention.

A Si content range within the limits from 0.05% to 1.5% by weight, and especially from 0.5% by weight to 1.5% by weight, is assessed as being advantageous.

For the element boron, a content from 0.01% to 0.6% by weight is considered to be advantageous. A particularly advantageous boron content has been found to be from 0.1% to 0.6% by weight.

For the assurance of a sufficient content of hard particles and of boron silicates, phosphorus silicates and/or boron phosphorus silicates, the establishment of a specific element ratio of the elements silicon and boron has been found to be important. For this reason, the Si/B ratio of the element contents (in % by weight) of the elements silicon and boron of the alloy of the invention is between 0.3 and 10. An Si/B ratio of 1 to 10 and additionally of 1 to 6 has been found to be particularly advantageous.

The precipitation of hard particles affects the viscosity of the melt of the alloy of the invention. This fact additionally emphasizes why an addition of phosphorus is indispensable. The effect of phosphorus is that the melt is sufficiently mobile in spite of the content of hard particles, which is of great significance for the castability of the invention. The phosphorus content of the alloy of the invention is 0.001% to 0.08% by weight. An advantageous P content is within the range from 0.001% to 0.05% by weight.

The sum total of the element contents of the elements silicon, boron and phosphorus is advantageously at least 0.5% by weight.

Machine processing of the semifinished products and components made of the conventional copper-tin and copper-tin-phosphorus kneading alloys, especially with a Sn content up to about 9% by weight, is possible only with great difficulty due to inadequate machinability. Thus, in particular, the occurrence of long turnings causes long machine shutdown times since the turnings first have to be removed by hand from the processing area of the machine.

In the case of the alloy of the invention, by contrast, the hard particles in the regions of which the element tin and/or the δ phase has crystallized or precipitated out according to the Sn content of the alloy act as a turning breaker. The short friable turnings and/or entangled turnings that thus arise facilitate machinability and, for that reason, the semifinished products and components made from the alloy of the invention have better machine processibility.

In an advantageous embodiment of the invention, the tin-containing copper alloy may consist of (in % by weight):
4.0% to 9.0% Sn,
0.05% to 2.0% Si,
0.01% to 0.6% B,
0.001% to 0.08% P, and
the balance being copper and unavoidable impurities.

In a further advantageous embodiment of the invention, the tin-containing copper alloy may consist of (in % by weight):
4.0% to 9.0% Sn,
0.05% to 0.3% Si,
0.1% to 0.6% B,
0.001% to 0.05% P, and
the balance being copper and unavoidable impurities.

In a particularly advantageous embodiment of the invention, the tin-containing copper alloy may consist of (in % by weight):
4.0% to 9.0% Sn,
0.5% to 1.5% Si, 0.01% to 0.6% B,
0.001% to 0.05% P, and
the balance being copper and unavoidable impurities.

In the cast microstructure of these embodiments of the invention, the Sn-rich δ phase is arranged homogeneously in an island form at up to 40% by volume. The element tin and/or the δ phase here is usually crystallized in the regions of the hard particles and/or ensheaths these.

The castings of these embodiments have an excellent hot formability at the working temperature in the range from 600 to 880° C. As a result of the dynamic recrystallization promoted by the hard particles that has taken place, the microstructure of the embodiments has a very fine-grain structure after the hot forming operation. This results in very good cold formability with a degree of cold forming ε of more than 40%.

The hard particles precipitated within the microstructure act as recrystallization seeds in the thermal treatment of the cold-formed material state at the temperature of 200 to 880° C. for a duration of 10 minutes to 6 hours. By means of this further processing step, it is possible to establish a microstructure having a grain size of up to 20 μm. The favoring of the recrystallization mechanisms by the hard particles allows the recrystallization temperature to be lowered, such that it is possible to produce a microstructure having a grain size down to 10 μm. By means of a multistage manufacturing process composed of cold forming and annealing operations and/or by means of a purpose-specific lowering of the recrystallization temperature, it is even possible to set the size of the crystallites in the material microstructure to below 5 μm.

The mechanical properties of some embodiments are representative of the entire range of alloy compositions and of the manufacturing parameters. The results of the study of corresponding working examples and those that are outlined hereinafter illustrate that it is possible to achieve values for tensile strength $R_m$ of more than 700 to 800 MPa, values for yield point $R_{p0.2}$ of more than 600 to 700 MPa. At the same time, the ductility properties of the embodiments are at a very high level. This fact is expressed by the high values for the elongation at break A5.

In an advantageous embodiment of the invention, the tin-containing copper alloy may consist of (in % by weight):
9.0% to 13.0% Sn,
0.05% to 2.0% Si,
0.01% to 0.6% B,
0.001% to 0.08% P, and
the balance being copper and unavoidable impurities.

In a further advantageous embodiment of the invention, the tin-containing copper alloy may consist of (in % by weight):
9.0% to 13.0% Sn,
0.05% to 0.3% Si,
0.1% to 0.6% B,
0.001% to 0.05% P, and
the balance being copper and unavoidable impurities.

In a particularly advantageous embodiment of the invention, the tin-containing copper alloy may consist of (in % by weight):
9.0% to 13.0% Sn,
0.5% to 1.5% Si,
0.01% to 0.6% B,
0.001% to 0.05% P, and
the balance being copper and unavoidable impurities.

The microstructure of these embodiments of the invention is characterized by a content of the δ phase of up to 60% by volume, this phase type being distributed homogeneously in the microstructure in an island form and a network form. Again, the element tin and/or the δ phase here is usually crystallized in the regions hard particles and/or ensheaths these.

The castings of these embodiments have an excellent hot formability at the working temperature in the range from 600 to 880° C.

As a result of the dynamic recrystallization promoted by the hard particles that has taken place, the microstructure of the embodiments has a very fine-grain structure after the hot forming operation. This results in a very good cold formability, which can be further improved by accelerated cooling after hot forming under air or in water and/or by an annealing treatment after the hot forming operation at the temperature of 200 to 880° C. for a duration of 10 minutes to 6 hours. After the operating step of hot forming, the microstructure feature of the crystallization of the element tin and/or of the δ phase in the regions of the hard particles and/or the ensheathing of these hard particles with the element tin and/or the δ phase is more completely manifested with regard to the cast state.

The hard particles precipitated within the microstructure act as recrystallization seeds in the thermal treatment of the cold-formed material state at the temperature of 200 to 880° C. for a duration of 10 minutes to 6 hours. By means of this further processing step, it is possible to establish a finer-grain microstructure. The favoring of the recrystallization mechanisms by the hard particles allows the recrystallization temperature to be lowered, such that it is possible to produce a microstructure having a further-reduced grain size. By means of a multistage manufacturing operation composed of cold forming and annealing operations, it is possible to further optimize the fine-grain structure of the microstructure.

In an advantageous embodiment of the invention, the tin-containing copper alloy may consist of (in % by weight):
13.0% to 17.0% Sn,
0.05% to 2.0% Si,
0.01% to 0.6% B,
0.001% to 0.08% P, and
the balance being copper and unavoidable impurities.

In a further advantageous embodiment of the invention, the tin-containing copper alloy may consist of (in % by weight):
13.0% to 17.0% Sn,
0.05% to 0.3% Si,
0.1% to 0.6% B,
0.001% to 0.05% P, and
the balance being copper and unavoidable impurities.

In a particularly advantageous embodiment of the invention, the tin-containing copper alloy may consist of (in % by weight):
13.0% to 17.0% Sn,
0.5% to 1.5% Si,
0.01% to 0.6% B,
0.001% to 0.05% P, and
the balance being copper and unavoidable impurities.

The δ phase in the cast microstructure of these embodiments of the invention is in the form of a homogeneously arranged network at up to 80% by volume. The element tin and/or the δ phase here is usually crystallized in the regions of the hard particles and/or ensheaths these.

The castings of these embodiments likewise have an excellent hot formability at the working temperature in the range from 600 to 880° C. Specifically within this content range for the alloy element tin from 13.0% to 17.0% by weight, the conventional copper-tin alloys are hot-formable only with very great difficulty without the occurrence of heat cracks and heat fractures.

As a result of the dynamic recrystallization promoted by the hard particles, that has taken place, the microstructure of the embodiments has a very fine-grain structure after the hot forming operation. This gives rise to very good cold formability, which can be further improved with the performance of accelerated cooling of the semifinished products under air or in water after the hot forming and/or by an annealing treatment after the hot forming operation at the temperature of 200 to 880° C. for a duration of 10 minutes to 6 hours. After the operating step of hot forming, the microstructure feature of the crystallization of the element tin and/or of the δ phase in the regions of the hard particles and/or of the ensheathing of these hard particles with the element tin and/or the δ phase is more complete with regard to the cast state.

The hard particles precipitated within the microstructure act as recrystallization seeds in the thermal treatment of the cold-formed material state at the temperature of 200 to 880° C. for a duration of 10 minutes to 6 hours. By means of this further processing step, it is possible to establish a microstructure having a grain size of up to 30 μm. The favoring of the recrystallization mechanisms by the hard particles allows the recrystallization temperature to be lowered, such that it is possible to produce a microstructure having a grain size of up to 15 μm. The network-like arrangement of the δ phase in the microstructure is conserved.

By means of a multistage manufacturing operation composed of cold forming and annealing operations and/or a purpose-specific lowering of the recrystallization temperature, it is even possible to adjust the size of the crystallites in the material microstructure to below 5 μm.

In an advantageous embodiment of the invention, the tin-containing copper alloy may consist of (in % by weight):
17.0% to 23.0% Sn,
0.05% to 2.0% Si,
0.01% to 0.6% B,
0.001% to 0.08% P, and
the balance being copper and unavoidable impurities.

In a further advantageous embodiment of the invention, the tin-containing copper alloy may consist of (in % by weight):
17.0% to 23.0% Sn,
0.05% to 0.3% Si,
0.1% to 0.6% B,
0.001% to 0.05% P, and
the balance being copper and unavoidable impurities.

In a particularly advantageous embodiment of the invention, the tin-containing copper alloy may consist of (in % by weight):
17.0% to 23.0% Sn,
0.5% to 1.5% Si,
0.01% to 0.6% B,
0.001% to 0.05% P, and
the balance being copper and unavoidable impurities.

A very dense network of the δ phase in a homogeneous arrangement with up to 98% by volume in the cast microstructure is a feature of the embodiments of the invention. The element tin and/or the δ phase usually crystallizes here in the regions of the hard particles and/or ensheaths these.

As a result of the homogeneity of the dense δ phase, the castings of these embodiments also have an excellent hot formability at the working temperature in the range from 600 to 880° C.

During the adhesive wear stress on a component made of the tin-containing copper alloy of the invention, the alloy element tin makes a particular contribution to the formation of what is called a tribological layer between the friction partners. Particularly under mixed friction conditions, this mechanism is important when the dry-running properties of a material come increasingly to the forefront. The tribological layer leads to a decrease in the size of the purely metallic contact area between the friction partners which prevents welding or seizing of the elements.

The rise in the efficiency of modern engines, machines and aggregates results in higher operating pressures and operating temperatures. This is observed particularly in the newly developed internal combustion engines where the aim is ever more complete combustion of the fuel. In addition to the elevated temperatures within the chamber of the internal combustion engines, there is also the evolution of heat that occurs during the operation of the slide bearing systems. Due to the high temperatures in a bearing operation, there is formation of boron silicates, phosphorus silicates and/or boron phosphorus silicates in the parts made of the alloy of the invention similar to that formed during the casting operation and the hot forming operation. These compounds strengthen the tribological layer, which results in an enhanced adhesive wear resistance of the sliding elements made of the alloy of the invention.

Even during the casting operation of the invention, there is precipitation of the hard particles in the microstructure. These hard phases protect the material from the consequences of abrasive wear stress, i.e. from removal of material by scoring wear. In addition, the hard particles have a low tendency to welding with the metallic friction partner, and therefore, they assure high adhesive wear resistance of the invention together with the tribological layer of a complex structure.

As well as their function as wear substrates, the hard particles have a higher thermal stability of the microstructure of the copper alloy of the invention. This results in a high heat resistance and an improvement in the stability of the material against stress relaxation.

In the cast variant and the further-processed variant of the alloy of the invention, the following optional elements may be present:

The element zinc may be added to the tin-containing copper alloy of the invention with a content from 0.1% to 2.0% by weight. It was found that the alloy element zinc, depending on the Sn content of the alloy, increases the proportion of Sn-rich phases in the invention which results in an increase in strength and hardness. However, it was not possible to find any indication that the addition of zinc has a positive effect on the homogeneity of the microstructure and on the further decrease in the content of pores and cracks in the microstructure. It is obvious that the influence of the combined alloy content of boron, silicon and phosphorus in this regard is predominant. Below 0.1% by weight of Zn, no strength- and hardness-enhancing effect was observed. In the case of Zn contents above 2.0% by weight, the toughness properties of the alloy were reduced to a lower level. Moreover, there was a deterioration in the corrosion resistance of the tin-containing copper alloy of the invention. Advantageously, a zinc content in the range from 0.5% to 1.5% by weight can be added to the invention.

For a further improvement in the mechanical material properties of strength and hardness and in stress relaxation resistance at elevated temperatures, the alloy elements iron and magnesium can be added individually or in combination.

The alloy of the invention may contain 0.01% to 0.6% by weight of iron. Therefore, in the microstructure, there is up to 10% by volume of Fe borides, Fe phosphides and Fe silicides and/or Fe-rich particles. In addition, in the microstructure, there is the formation of addition compounds and/or mixed compounds of the Fe-containing phases and of the Si-containing and B-containing phases. These phases and compounds contribute to an increase in strength, in hardness, in heat resistance, in stress relaxation resistance, in electrical conductivity, and to an improvement in the resistance to abrasive and adhesive wear stress on the alloy. In the case of an Fe content below 0.01% by weight, this improvement in properties is not achieved. If the Fe content exceeds 0.6% by weight, there is the risk of the cluster formation of the iron in the microstructure. This would be associated with a crucial deterioration in the processing properties and the use properties.

In addition, the element magnesium may be added to the alloy of the invention from 0.01% to 0.5% by weight. In this case, up to 15% by volume of Mg borides, Mg phosphides and Cu—Mg phases and Cu—Sn—Mg phases are present in the microstructure. In addition, in the microstructure, there is formation of addition compounds and/or mixed compounds of the Mg-containing phases and of the Si-containing and B-containing phases. These phases and compounds also contribute to an increase in strength, in hardness, in heat resistance, in stress relaxation resistance, in electrical conductivity, and to an improvement in the resistance to abrasive and adhesive wear stress on the alloy. In the case of an Mg content below 0.01% by weight, this improvement in properties is not achieved. If the Mg content exceeds 0.5% by weight, there is a deterioration in the castability of the alloy in particular. Moreover, the excessively high content of Mg-containing compounds would worsen the toughness properties of the alloy of the invention to a crucial degree.

The tin-containing copper alloy may or may not include small proportions of lead. Lead contents that are still just acceptable, and above the contamination limit, are up to a maximum of 0.25% by weight. In a particularly preferred advantageous embodiment of the invention, the tin-containing copper alloy is free of lead apart from any unavoidable impurities. In this respect, lead contents up to a maximum of 0.1% by weight of Pb are contemplated.

A particular advantage of the invention is considered to be the substantial freedom of the microstructure from gas pores and shrinkage pores, craters, segregations, and cracks in the cast state. This results in the particular suitability of the alloy of the invention as an antiwear layer which is melted, for example, onto a main body made of steel. In particular, the alloy composition of the invention can suppress the formation of open porosity in the melting process which increases the compressive strength of the sliding layer.

A further particular advantage of the invention is the elimination of the absolute necessity of performing a specific primary forming technique, for example that of spray compaction or of thin strip casting, for provision of a homogeneous, substantially pore-free and segregation-free microstructure. For the establishment of such a microstructure, it is possible to use conventional casting methods for the primary forming operation of the alloy of the invention. Thus, one aspect of the invention includes a process for producing end products or components in the near-end-product form from the tin-containing copper alloy of the invention with the aid of the sandcasting process, shell mold casting process, precision casting process, full mold casting process, pressure diecasting process, or lost foam process.

Moreover, one aspect of the invention includes a process for producing strips, sheets, plates, bolts, round wires, profile wires, round bars, profile bars, hollow bars, pipes and profiles from a tin-containing copper alloy of the invention with the aid of the permanent mold casting process or the continuous or semicontinuous strand casting process.

It is remarkable that, after the permanent mold casting or strand casting of the shapes from the alloy of the invention, there is also no need to conduct any complex forging processes and/or indentation processes at elevated temperature in order to weld, i.e. to close, pores and cracks in the material.

Moreover, in the invention, for the assurance of sufficient hot formability, it is no longer absolutely necessary to more finely distribute the Sn-rich δ phase, which is present according to the Sn content, in the microstructure or to dissolve it by homogenization annealing or solution annealing, and hence to eliminate it. The δ phase which is in any case homogeneously and finely distributed in the cast microstructure of the alloy of the invention with an appropriate Sn content assumes an essential function for the use properties of the alloy.

In a preferred configuration of the invention, the further processing of the cast state may include the performance of at least one hot forming operation within the temperature range from 600 to 880° C.

Advantageously, the semifinished products and components after the hot forming can be cooled down using calmed or accelerated air or with water.

Advantageously, at least one annealing treatment of the cast state and/or of the hot-formed state of the invention can be conducted within the temperature range from 200 to 880° C. for the duration of 10 minutes to 6 hours, or alternatively with cooling using calmed or accelerated air or with water.

One aspect of the invention relates to an advantageous method of further processing of the cast state or of the hot-formed state or of the annealed cast state or of the annealed hot-formed state, which comprises the performance of at least one cold forming operation.

Preferably, at least one annealing treatment of the cold-formed state of the invention can be conducted within the temperature range from 200 to 880° C. for the duration of 10 minutes to 6 hours.

Advantageously, a stress relief annealing/age annealing operation can be conducted within the temperature range from 200 to 650° C. for the duration of 0.5 to 6 hours.

The matrix of the homogeneous microstructure of the invention consists of a ductile a phase with proportions of the δ phase according to the Sn content of the alloy. By virtue of its high strength and hardness, the δ phase leads to high resistance of the alloy to abrasive wear. Moreover, the δ phase, due to its high Sn content, which results in its tendency to form a tribological layer, increases the resistance of the material to adhesive wear. The hard particles are intercalated in the metallic base material. In further executions of the invention, there are additionally Fe- and/or Mg-containing phases in the metallic base material.

This heterogeneous microstructure consisting of a metallic base material composed of α and δ phases, in which precipitates of high hardness are intercalated, imparts an excellent combination of properties to the subject matter of the invention. The following should be mentioned in this connection: high strength values and hardness values with a simultaneously good toughness, excellent hot formability, adequate cold formability, high thermal stability of the microstructure with resulting high heat resistance and high stress relaxation resistance, adequate electrical conductivity for many applications, high corrosion resistance, and high resistance to the wear mechanisms of abrasion, adhesion, surface breakup and to oscillating friction wear called fretting.

Due to the homogeneous and fine-grain microstructure with substantial freedom from pores, freedom from cracks, freedom from segregations, and the content of hard particles, the alloy of the invention has a high degree of strength, hardness, ductility, complex wear resistance, and corrosion resistance, even in the cast state. For this reason, the alloy of the invention, even in the cast state, has a wide spectrum of use.

The result is the particular suitability of the alloy of the invention as an antiwear layer which is melted, for example, onto a main body made of steel. In this regard, it should be emphasized that the treatment temperatures for quenched and tempered steels (hardening 820 to 860° C., annealing 540 to 660° C.; DIN EN 10083-1) are within the heat treatment range of the invention. This means that, after the melting of the tin-containing copper alloy onto a main body made of quenched and tempered steel, the mechanical properties of the two composite partners can be optimized in just one treatment step. A further advantage is that, in the melting operation, the formation of open porosity is suppressed, which increases the compressive strength of the antiwear layer.

Apart from melting, there are also further useful joining methods. In this respect, composite production by means of forging, soldering or welding would also be conceivable, with the optional performance of at least one annealing operation within the temperature range from 200 to 880° C. It is likewise possible to produce, for example, bearing composite shells or bearing composite bushings by roll cladding, inductive or conductive roll cladding, or by laser roll cladding.

Even the cast shapes in strip form, sheet form, plate form, bolt form, wire form, rod form, tube form or profile form can be used to produce sliding elements and guide elements in internal combustion engines, valves, turbochargers, gears, exhaust gas aftertreatment systems, lever systems, braking systems and joint systems, hydraulic aggregates, or in machines and installations in mechanical engineering in general. By means of a further processing of the cast state, it is possible to produce semifinished products and components having complicated geometry and enhanced mechanical properties and optimized wear properties for these end uses. This takes account of the elevated component demands under a dynamic stress.

Another aspect of the invention includes the use of the tin-containing copper alloy of the invention for components, wire elements, guiding elements and connecting elements in electronics/electrical engineering.

By virtue of the excellent strength properties, wear resistance, and corrosion resistance of the tin-containing copper alloy of the invention, there is a further possible use. Thus, the invention is suitable for the metallic articles in constructions for the breeding of seawater-dwelling organisms (aquaculture). A further aspect of the invention includes use of the tin-containing copper alloy of the invention for propellers, wings, marine propellers and hubs for shipbuilding, for housings of water pumps, oil pumps and fuel pumps, for guide wheels, runner wheels and paddle wheels for pumps and water turbines, for gears, worm gears, helical gears and for forcing nuts and spindle nuts, and for pipes, seals and connection bolts in the maritime and chemical industry.

For the use of the alloy of the invention for the production of percussion instruments, the material is of great significance. Especially cymbals of high quality are manufactured from tin-containing copper alloys by means of hot forming and at least one annealing operation before they are converted to the final shape, usually by means of a bell or shell. Subsequently, the symbols are annealed once again before the material-removing final processing thereof. The production of the various variants of the cymbal, for example ride cymbals, hi-hats, crash cymbals, china cymbals, splash cymbals and effect cymbals, accordingly requires particularly advantageous hot formability of the material which is assured by the alloy of the invention. Within the range limits of the chemical composition of the invention, different microstructure components for the δ phase and for the hard particles can be set within a very wide range. In this way, it is possible even from an alloy point of view to affect the sound characteristics of the cymbals.

Further important working examples of the invention are illustrated in Tables 1 to 11. Cast blocks of the tin-containing copper alloy of the invention were produced by permanent mold casting. The chemical composition of the castings is apparent from Tables 1 and 3.

Table 1 shows the chemical composition of alloy variants 1 and 2. These materials are characterized by a Sn content of 7% by weight, a P content of 0.015% by weight and by a different element ratio of the elements silicon and boron, and a balance of copper.

TABLE 1

Chemical composition of the working examples 1 and 2

| | Cu | Sn | P | Si | B |
|---|---|---|---|---|---|
| 1 | balance | 7.18 | 0.015 | 0.66 | 0.26 |
| 2 | balance | 7.08 | 0.015 | 0.19 | 0.40 |

After the casting, the microstructure of the working examples 1 and 2 is shaped by a very homogeneous, mostly island-like distribution of a comparatively small proportion of the δ phase (about 15 to 20% by volume) and of the hard particles. The microstructure of the cast state of the alloy 1 is shown in FIG. 1 (200-fold magnification). What can be seen is the Sn-rich δ phase 1 arranged homogeneously in the manner of islands in the solid copper solution 3 that consists of the tin-deficient a phase. Also apparent are the hard particles 2 ensheathed by tin and/or the Sn-rich δ phase.

The hardness of these alloys is 105 HB for the alloy 1 and 98 HB for the alloy 2 (Table 2).

TABLE 2

Hardness of the permanent mold casting blocks from the working examples 1 and 2

| Alloy | Hardness HB 2.5/62.5 |
|---|---|
| 1 | 105 |
| 2 | 98 |

Table 3 shows the chemical composition of a further alloy variant 3. This material contains, as well as about 15% by weight of Sn and 0.024% by weight of P, the further elements Si (0.77% by weight) and boron (0.20% by weight).

TABLE 3

| Chemical composition of the working example 3 | | | | | |
|---|---|---|---|---|---|
| | Cu | Sn | P | Si | B |
| 3 | balance | 15.03 | 0.024 | 0.77 | 0.20 |

Figure 3:
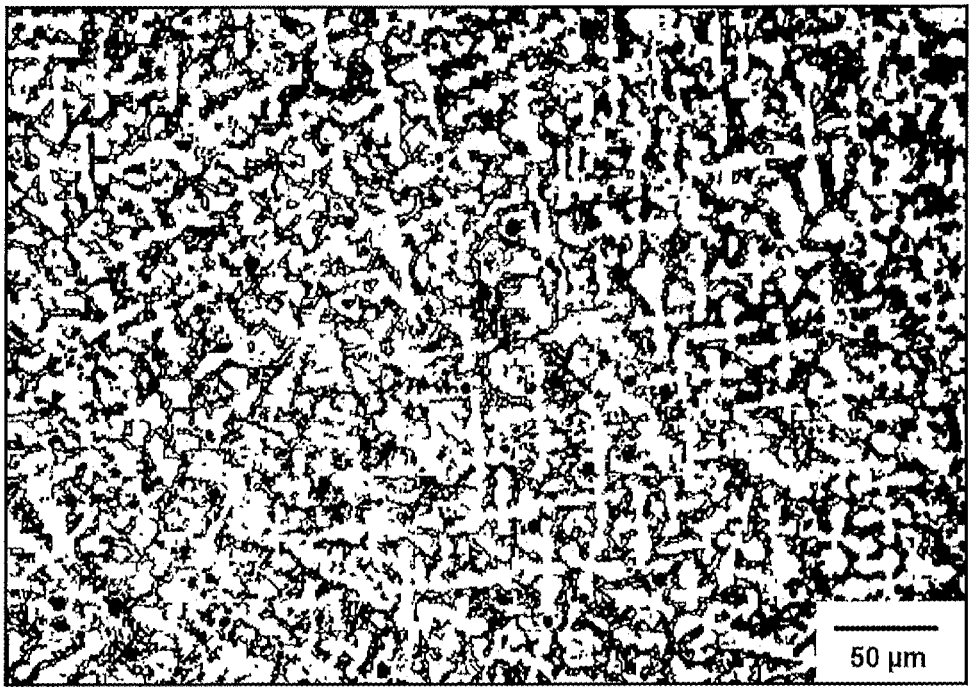
Figure 4:
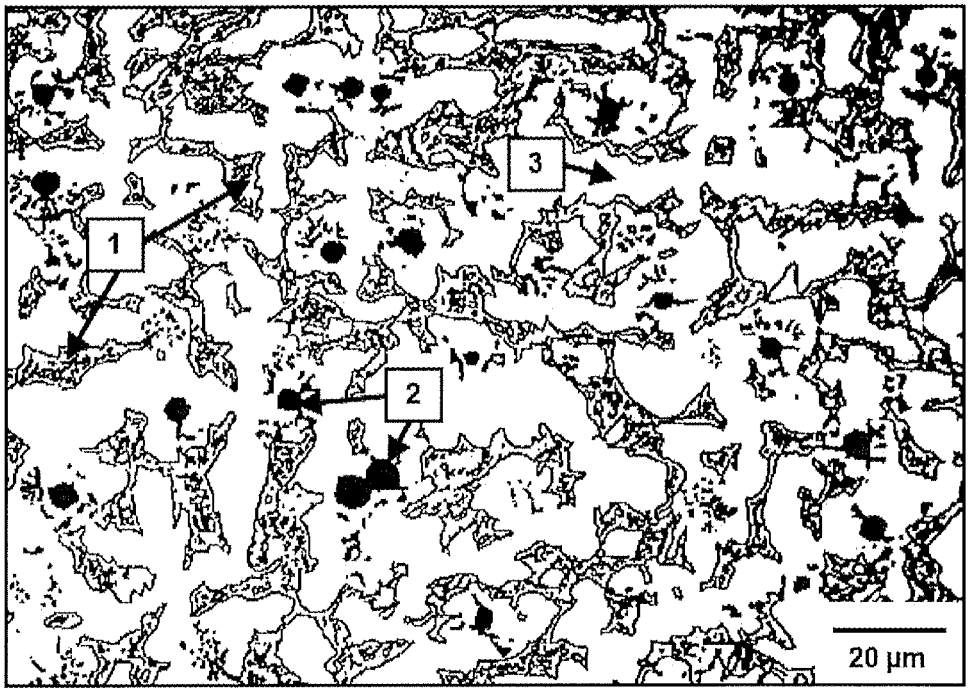

One characteristic feature of the invention is that the microstructure in the cast state, with the rising Sn content of the alloy, depending on the casting/cooling operation, consists of increasing proportions of the δ phase. The arrangement of this Sn-rich δ phase is transformed from a finely distributed island form, with the increasing Sn content of the alloy, to a dense network form. In the cast microstructure of the alloy type 3, the δ phase is present with a distinctly higher content (up to about 70% by volume). This microstructure is shown in FIG. 3 in 200-fold magnification and in FIG. 4 in 500-fold magnification. Reference numeral 1 in FIG. 4 indicates the Sn-rich δ phase arranged in a network-like manner in the microstructure. In addition, the hard particles 2 that are ensheathed by tin and/or the Sn-rich δ phase are apparent. The microstructure constituent of the solid copper solution is labeled by reference numeral 3.

The increase in hardness of the material with a rising Sn content is expressed by the distinctly higher value of 190 HB of the alloy 3 (Table 4).

TABLE 4

| Hardness of the permanent mold casting blocks from the working example 3 | |
|---|---|
| Alloy | Hardness HB 2.5/62.5 |
| 3 | 190 |

One aspect of the invention relates to a process for production of strips, sheets, plates, bolts, wires, bars, profile bars, hollow bars, pipes and profiles from the tin-containing copper alloy of the invention with the aid of the permanent mold casting process or the continuous or semicontinuous strand casting process.

The alloy of the invention can additionally be subjected to further processing. First, this enables the production of particular and often complicated geometries. Second, in this way, the demand for an improvement in the complex operating properties of the materials, particularly for wear-stressed components and for components and connection elements in electronics/electrical engineering is met, since there is a significant increase in stress on the system elements in the corresponding machines, engines, gears, aggregates, constructions and installations. In the course of this further processing, a significant improvement in the toughness properties and/or a significant increase in tensile strength $R_m$, yield point $R_{p0.2}$ and hardness is achieved.

Due to the excellent hot formability of the alloy of the invention, the further processing of the cast state can advantageously include the performance of at least one hot forming operation within the temperature range from 600 to 880° C. By means of hot rolling, it is possible to produce plates, sheets and strips. Extrusion enables the manufacture of wires, rods, tubes and profiles. Finally, forging processes are suitable for producing near-end-shape components with a complicated geometry in some cases.

A further advantageous means of a further processing the cast state or the hot-formed state or the annealed cast state or the annealed hot-formed state comprises the performance of at least one cold forming operation. In particular, this process step significantly increases the material indices $R_m$, $R_{p0.2}$ and the hardness. This is important for applications where there is a mechanical stress, and/or an intense abrasive wear stress, and/or an adhesive wear stress on the components. In addition, the spring properties of the components made of the alloy of the invention are significantly improved as a result of a cold forming operation.

For corresponding recrystallization of the microstructure of the invention after a cold forming operation, it is possible to conduct at least one annealing treatment within a temperature range from 200 to 880° C. for the duration of 10 minutes to 6 hours. The very fine-grain structure that thus forms is an important prerequisite for establishing the combination of properties of high-strength and hardness and of sufficient toughness of the material.

For lowering of the residual stresses of the components, it is advantageously additionally possible to conduct a stress relief/age annealing operation within a temperature range from 200 to 650° C. for the duration of 0.5 to 6 hours.

For the fields of use having particularly severe complex component stress, it is possible to choose a further processing operation comprising at least one cold forming operation, or the combination of at least one hot forming operation and at least one cold forming operation in conjunction with at least one annealing operation within a temperature range from 200 to 800° C. for the duration of 10 minutes to 6 hours and leads to a recrystallized microstructure of the alloy of the invention. The fine-grain structure of the alloy established in this way assures a combination of high strength, high hardness, and good toughness properties. In addition, for lowering of the residual stresses of the components, a stress relief annealing treatment within the temperature range from 200 to 650° C. for the duration of 0.5 to 6 hours is possible.

For manufacture of the semifinished products in strip form from the working examples 1 and 2 (Table 1), three different production sequences were selected. They differ primarily in the number of cold forming/annealing cycles and in the level of the degrees of cold forming and annealing temperatures employed (Table 5).

TABLE 5

| Manufacturing programs for the working examples 1 and 2 | | | |
|---|---|---|---|
| No. | Manufacture 1 | Manufacture 2 | Manufacture 3 |
| 1 | Permanent mold casting | | |
| 2 | Hot rolling at 780° C. + water quenching | | |
| 3 | Cold rolling:<br>1: from 7.39 to 2.1 mm (ε ≈ 72%)<br>2: from 7.34 to 2.1 mm (ε ≈ 71%) | | |
| 4 | Stress relief annealing at 280° C./2 h | Annealing 680° C./3 h | Annealing 450° C./3 h |
| 5 | — | Cold rolling (ε ≈ 60%):<br>1: from 2.1 to 0.84 mm<br>2: from 2.1 to 0.84 mm | Cold rolling (ε ≈ 30%):<br>1: from 2.1 to 1.47 mm<br>2: from 2.1 to 1.47 mm |
| 6 | — | Stress relief annealing 280-400° C./2-4 h | Stress relief annealing 240-360° C./2 h |

After the permanent mold casting and the hot rolling, the corresponding blocks or semifinished products are characterized by an exceptionally smooth surface. As a result of the dynamic recrystallization of the microstructure that has taken place during the hot rolling operation, the hot-formed state of both alloy variants 1 and 2 has an excellent cold formability. Thus, it was possible to cold-roll the hot-rolled plates without cracking with a cold-forming ε of about 70%.

In the course of the manufacture 1, the cold-rolled strips were annealed at the temperature of 280° C. for a duration of 2 hours. The indices of the strips thus subjected to stress relief are apparent from Table 6. In spite of the high strength and hardness values, the strips of both alloys have extremely good toughness properties as measured by the high values for the elongation at break A5.

TABLE 6

Microstructure characteristics and mechanical indices of the strips of the working examples 1 and 2 in the final state (manufacture 1)

| Alloy | Electrical conductivity [% IACS] | $R_m$ [MPa] | $R_{p0.2}$ [MPa] | A5 [%] | Hardness HB 1.0/10 |
|---|---|---|---|---|---|
| 1 | 9.8 | 820 | 767 | 12.9 | 244 |
| 2 | 12.6 | 757 | 660 | 14.1 | 256 |

An indication of the importance of the Si/B element ratio of the elements silicon and boron is given by the comparison of the individual data for the strips made from the alloys 1 and 2. Due to the higher Si/B ratio of the alloy 1 of about 2.5, the boron silicates, phosphorus silicates and/or boron phosphorus silicates are formed to an enhanced degree during the casting and during the thermal and thermomechanical production steps. For this reason, in various tests, the superiority of the alloy 1 with regard to the corrosion resistance by comparison with the alloy 2 was established. In addition, the values for $R_m$ and $R_{p0.2}$ of the strips made from the alloy 1 are at a much higher level. As a result of the lower Si/B ratio at about 0.5, a higher Si content was bound in the hard particles in the microstructure of the alloy 2. This results particularly in a higher electrical conductivity and an increased elongation at break A5, which results in the better ductility of the alloy 2. Even the results from the manufacture 1 suggest that the properties can be matched exactly to the respective fields of use with a variation of the chemical composition of the invention.

In the course of manufacture 2, the strips of alloy variants 1 and 2, after the first cold rolling operation, were annealed at 680° C. for 3 hours. This was followed by the cold rolling of the strips with a cold-forming ε of about 60%. To complete the manufacture, the strips were subjected to thermal stress relief at different temperatures between 280 and 400° C. The indices of the resulting material states are listed in Table 7.

As with the manufacture 1, the states of the working example 1 show the higher strength values, whereas the working example 2 features higher values for electrical conductivity and for the elongation at break A5. Furthermore, it can be inferred from Table 7 that the microstructure of the strips subjected to stress relief at 280° C. include deformation features, and therefore no value can be reported for the grain size. At about 340° C., the recrystallization of the microstructure sets in, which leads to a significant drop in strengths and in the hardness.

TABLE 7

Microstructure characteristics and mechanical indices of the strips of the working examples 1 and 2 in the end state (manufacture 2)

| Alloy | Stress relief annealing temperature [° C.] | Grain size [μm] | Electrical conductivity [% IACS] | $R_m$ [MPa] | $R_{p0.2}$ [MPa] | A5 [%] | Hardness HB 1.0/10 |
|---|---|---|---|---|---|---|---|
| 1 | 280° C./2 h | — | 9.9 | 790 | 752 | 9.5 | 249 |
| | 280° C./4 h | — | 10.0 | 780 | 730 | 9.9 | 266 |
| | 340° C./2 h | 2 | 10.0 | 571 | 430 | 45.6 | 173 |
| | 340° C./4 h | 2 | 9.9 | 565 | 417 | 43.0 | 168 |
| | 400° C./2 h | 4-5 | 9.8 | 529 | 342 | 54.5 | 143 |
| | 400° C./4 h | 4-5 | 9.9 | 523 | 327 | 56.8 | 143 |
| 2 | 280° C./2 h | — | 12.7 | 739 | 694 | 17.8 | 248 |
| | 280° C./4 h | — | 12.9 | 733 | 678 | 21.3 | 242 |
| | 340° C./2 h | 2-3 | 13.0 | 500 | 371 | 51.0 | 150 |
| | 340° C./4 h | 2-3 | 12.5 | 490 | 353 | 52.2 | 143 |
| | 400° C./2 h | 5-6 | 12.8 | 466 | 200 | 59.0 | 127 |
| | 400° C./4 h | 5-6 | 12.3 | 475 | 296 | 57.0 | 124 |

For this reason, in the course of the manufacture 3, the annealing temperature after the first cold forming operation was lowered to 450° C. The annealing operation conducted at this temperature for three hours was followed by the cold rolling of the strips with the cold-forming ε of about 30%. The final stress relief annealing for two hours at temperatures between 240 and 360° C. led to the indices shown in Table 8.

Figure 2:
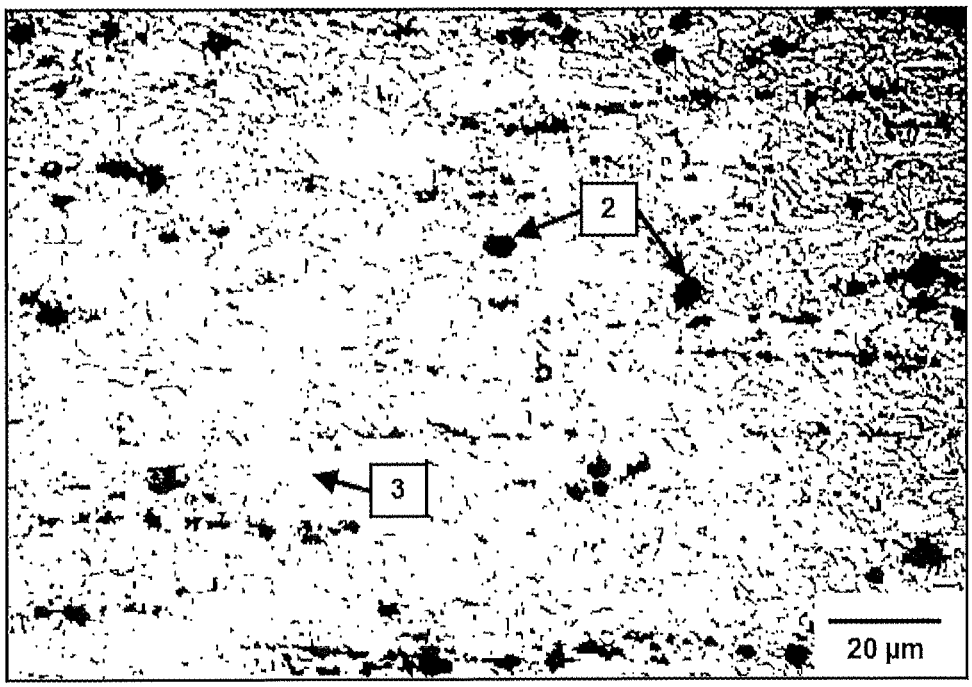

The microstructure with 500-fold magnification of the final state of the strip of the working example 1 that has been subjected to stress relief annealing at 240° C./2 h is shown in FIG. 2. What can be seen is the fine-grain microstructure with the hard phases 2 intercalated in the solid copper solution 3. The hard particles are ensheathed by tin and/or the Sn-rich δ phase 1.

The results point to a completely recrystallized microstructure having exceptionally high values for strength and hardness. Nevertheless, the high values for the elongation at break A5 indicate the excellent ductility of the material states. The strength values of the states of the alloy 1 are above those of the alloy 2 after the manufacture 3 as well. By contrast, the states of the alloy 2 offer advantages with regard to the elongation at break A5 and electrical conductivity.

TABLE 8

Microstructure characteristics and mechanical indices of the strips from the working examples 1 and 2 in the end state (manufacture 3)

| Alloy | Stress relief annealing temperature [° C.] | Grain size [μm] | Electrical conductivity [% IACS] | $R_m$ [MPa] | $R_{p0.2}$ [MPa] | A5 [%] | Hardness HB 1.0/10 |
|---|---|---|---|---|---|---|---|
| 1 | 240° C./2 h | 5-10 | 9.9 | 739 | 653 | 25.3 | 228 |
| | 280° C./2 h | 5-10 | 9.9 | 723 | 648 | 27.1 | 219 |
| | 320° C./2 h | 5-10 | 9.9 | 708 | 582 | 28.3 | 213 |
| | 360° C./2 h | 5-10 | 10.0 | 570 | 400 | 47.0 | 153 |
| 2 | 240° C./2 h | 5-10 | 12.8 | 668 | 598 | 26.7 | 204 |
| | 280° C./2 h | 5-10 | 12.9 | 653 | 557 | 32.4 | 197 |
| | 320° C./2 h | 5-10 | 12.7 | 636 | 544 | 34.3 | 189 |
| | 360° C./2 h | 5-10 | 12.9 | 536 | 390 | 43.6 | 149 |

The strips of the working example 3 of the invention, the chemical composition of which can be found in Table 3, were produced by the manufacturing program shown in Table 9. The hot rolling of the permanent mold casting shapes was carried out at the temperature of 750° C. with subsequent cooling using calmed air in water. The advantage of an accelerated cooling of the hot-formed semifinished product in water is manifested in the form of better cold formability. For instance, the hot-rolled strip that has been quenched in water can subsequently be cold-rolled with a cold-forming ε of 24%. By contrast, the strip that has been cooled under air after hot rolling permits only cold rolling with a cold-forming ε of about 5%.

TABLE 9

Manufacturing program for the working example 3

| No. | Manufacture | |
|---|---|---|
| 1 | Permanent mold casting | |
| 2 | 3-A, 3-B<br>Hot rolling at 750° C. + water quenching | 3-C<br>Hot rolling at 750° C. + air cooling |
| 3 | Cold rolling<br>3-A/B: from 7.20 to 5.50 mm (ε ≈ 24%) | Cold rolling<br>3-C: from 7.38 to 7.04 mm (ε ≈ 5%) |
| 4 | 3-A and 3-C<br>Annealing: 500° C./3 h, 550° C./3 h, 600° C./3 h + air cooling<br>3-B<br>Annealing: 600° C./4 h + air cooling | |
| 5 | Cold rolling<br>3-B: from 5.50 to 3.67 mm (ε ≈ 33%) | |
| 6 | 3-B<br>Annealing: 550° C./4 h + air cooling | |
| 7 | Cold rolling<br>3-B: from 3.67 to 2.05 mm (ε ≈ 44%) | |
| 8 | 3-B<br>Annealing: 500° C./3 h + air cooling | |
| 9 | Cold rolling<br>3-B: from 2.05 to 1.40 mm (ε ≈ 32%) | |
| 10 | 3-B<br>Stress relaxation annealing: 200° C./2 h, 240° C./2 h, 280° C./2 h, 320° C./2 h | |

The grain size and hardness of the cold-rolled state and of the cold-rolled and annealed state are shown in Table 10. As a result of the annealing treatment, the microstructure properties balance out at a high level with rising annealing temperatures.

TABLE 10

Grain size and hardness of the cold-rolled (after the manufacturing step 4 in Table 8) and subsequently annealed strips from the working example 3

| Alloy/state | Heat treatment | Grain size [μm] | Hardness HB 2.5/62.5 |
|---|---|---|---|
| 3-A | cold-rolled | 15-20 | 247 |
| (hot-rolled with water | 500° C./3 h + air | 5-10 | 188 |
| quenching + cold-rolled | 550° C./3 h + air | 10-15 | 178 |
| from 7.2 to 5.5 mm) | 600° C./3 h + air | 15-20 | 170 |
| 3-C | cold-rolled | 15-20 | 210 |
| (hot-rolled with air | 500° C./3 h + air | 15-20 | 182 |
| cooling + cold-rolled | 550° C./3 h + air | 20-25 | 174 |
| from 7.38 to 7.04 mm) | 600° C./3 h + air | 20-25 | 174 |

Figure 5:
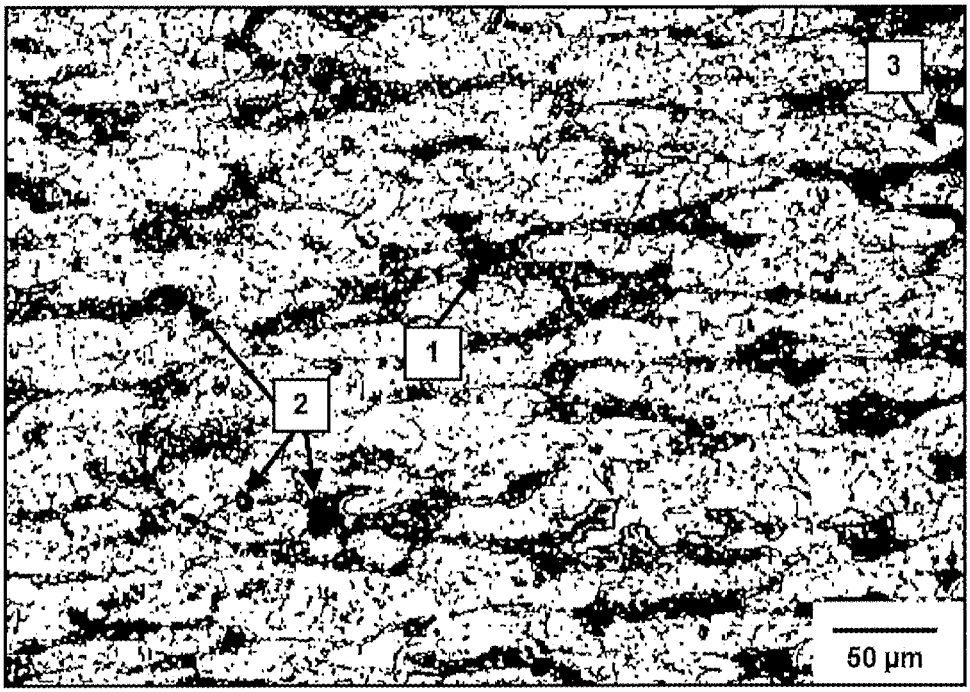
Figure 6:
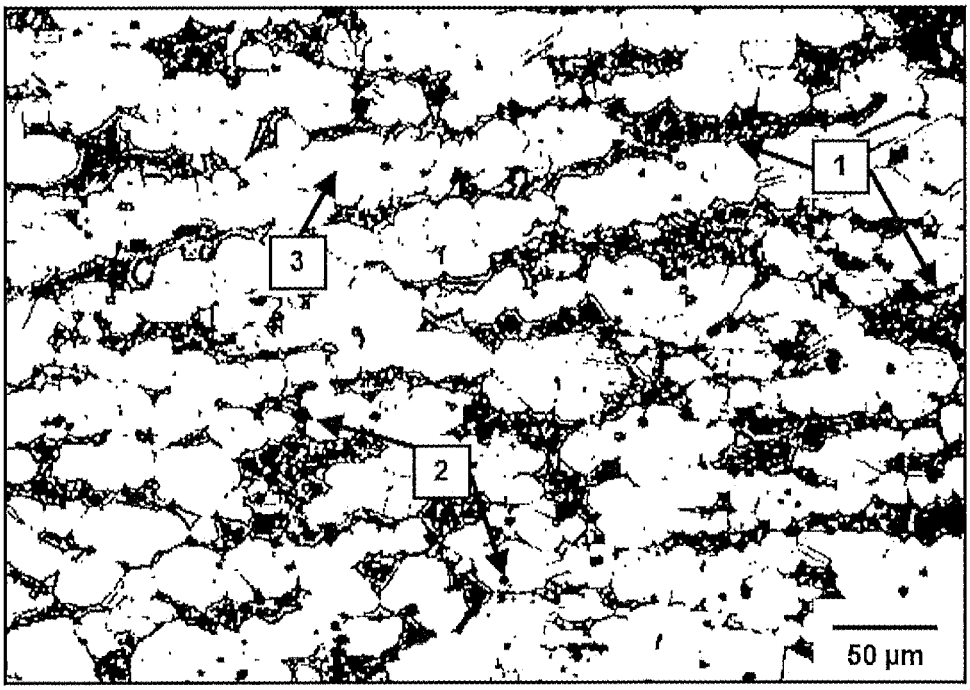

The microstructure of the strip 3-A was finally heat-treated with the parameters of 500° C./3 h+air and 600° C./3 h+air and is shown in FIG. 5 and FIG. 6. After annealing at 500° C./3 h (FIG. 5), the microstructure includes, as well as the Sn-rich δ phase 1, relatively course and very fine hard particles 2 ensheathed by tin and/or the Sn-rich δ phase 1. Also visible is the solid copper solution 3 consisting of a tin-deficient α phase. After the annealing at a higher temperature of 600° C., the microstructure of the strip 3-A is in coarse-grain form (FIG. 6). The Sn-rich δ phase 1 and the hard particles 2 are embedded in the solid copper solution 3.

The strip 3-B was subjected to further processing with multiple cold rolling/annealing cycles. The indices of the final states that have been subjected to stress relaxation at different temperatures are listed in Table 11.

With each cycle that consists of a cold rolling step and an annealing treatment, the microstructure of the working example 3 of the invention is continually stretched in a linear manner. The linear arrangement of the very high δ component, resulting from the high Sn content of the alloy, leads to high hardness values close to 300 HV1. At the same time, there is an increase in the brittle character of the alloy, which is expressed by the very low values for the elongation at A11.3.

TABLE 11

Microstructure characteristics and mechanical indices of the strips from the working example 3 in the final state

| Alloy/state | Stress relief annealing temperature [° C.] | Grain size [μm] | Electr. Conduct. [% IACS] | $R_m$ [MPa] | $R_{p0.2}$ [MPa] | A11.3 [%] | HV1 |
|---|---|---|---|---|---|---|---|
| 3-B | Cold-rolled | 2-3 | 6.3 | 574 | 477 | 0.4 | 282 |
| | 200° C./2 h | 3-4 | 6.5 | 734 | 693 | 0.3 | 294 |
| | 240° C./2 h | 3-4 | 6.5 | 731 | 658 | 0.6 | 283 |
| | 280° C./2 h | 2-3 | 6.5 | 702 | 621 | 0.7 | 281 |
| | 320° C./2 h | 2-3 | 6.7 | 703 | 628 | 0.7 | 275 |

As a result, it can be concluded that the alloy of the invention has an excellent castability and hot formability over the entire Sn content range from 4% to 23% Sn. Cold formability is also at a high level. However, there is a natural deterioration in the ductility of the invention with a rising Sn content due to the rising 6 component of the microstructure.

The invention claimed is:

1. A tin-containing copper alloy consisting of (in % by weight):

4.0% to 23.0% Sn,
0.05% to 2.0% Si,
0.005% to 0.6% B,
0.001% to 0.08% P,
optionally up to a maximum of 2.0% Zn,
optionally up to a maximum of 0.6% Fe,
optionally up to a maximum of 0.5% Mg,
optionally up to a maximum of 0.25% Pb,
the balance being copper and unavoidable impurities,
wherein
the Si/B ratio of the element contents of the elements silicon and boron is between 0.3 and 10.

2. A tin-containing copper alloy consisting of (in % by weight):

4.0% to 23.0% Sn,
0.05% to 2.0% Si,
0.005% to 0.6% B,
0.001% to 0.08% P,
optionally up to a maximum of 2.0% Zn,
optionally up to a maximum of 0.6% Fe,
optionally up to a maximum of 0.5% Mg,
optionally up to a maximum of 0.25% Pb,
the balance being copper and unavoidable impurities,
wherein
the Si/B ratio of the element contents of the elements silicon and boron is between 0.3 and 10;
after casting, the following microstructure constituents are present in the alloy:
a) 1% to 98% by volume of Sn-rich δ phase (1), b) 1% to 20% by volume of Si-containing and B-containing phases (2), c) the balance being a solid solution of copper, consisting of low-tin α phase (3), wherein the Si-containing and B-containing phases (2) are ensheathed by tin and/or the Sn-rich δ phase (1);

in the casting, the Si-containing and B-containing phases (2) which are in the form of silicon borides constitute seeds for homogeneous crystallization during the solidification/cooling of the melt, such that the Sn-rich δ phase (1) is distributed homogeneously in the microstructure in the form of islands and/or a network;

the Si-containing and B-containing phases (2) which are in the form of boron silicates and/or boron phosphorus silicates, together with phosphorus silicates, assume the role of a wear-protective and/or corrosion-protective coating on semifinished products and components of the alloy.

3. A tin-containing copper alloy consisting of (in % by weight):

4.0% to 23.0% Sn, 0.05% to 2.0% Si, 0.005% to 0.6% B, 0.001% to 0.08% P, optionally up to a maximum of 2.0% Zn, optionally up to a maximum of 0.6% Fe, optionally up to a maximum of 0.5% Mg, optionally up to a maximum of 0.25% Pb, the balance being copper and unavoidable impurities, wherein the Si/B ratio of the element contents of the elements silicon and boron is between 0.3 and 10;

after a further processing of the alloy by at least one annealing operation or by at least one hot forming operation and/or cold forming operation in addition to at least one annealing operation, the following microstructure constituents are present in the alloy:

a) up to 75% by volume of Sn-rich δ phase (1), b) 1% to 20% by volume of Si-containing and B-containing phases (2), c) the balance being a solid solution of copper, consisting of low-tin α phase (3), wherein the Si-containing and B-containing phases (2) are ensheathed by tin and/or the Sn-rich δ phase (1);

the Si-containing and B-containing phases (2) present, which are in the form of silicon borides, constitute seeds for static and dynamic recrystallization of the microstructure during the further processing of the alloy, which enables the establishment of a homogeneous and fine-grain microstructure;

the Si-containing and B-containing phases (2) which are in the form of boron silicates and/or boron phosphorus silicates, together with phosphorus silicates, assume the role of a wear-protective and/or corrosion-protective coating on the semifinished products and components of the alloy.

4. The tin-containing copper alloy as claimed in claim 1, wherein the element silicon is present at from 0.05% to 1.5%.

5. The tin-containing copper alloy as claimed in claim 1, wherein the element silicon is present at from 0.5% to 1.5%.

6. The tin-containing copper alloy as claimed in claim 1, wherein the element boron is present at from 0.01% to 0.6%.

7. The tin-containing copper alloy as claimed in claim 1, wherein the element phosphorus is present at from 0.001% to 0.05%.

8. The tin-containing copper alloy as claimed in claim 1, wherein the alloy is free of lead aside from any unavoidable impurities.

9. A process for producing end products and components having near-end-product form from a tin-containing copper alloy as claimed in claim 1 with the aid of a sandcasting process, a shell mold casting process, a precision casting process, a full mold casting process, a pressure diecasting process, or a lost foam process.

10. A process for producing strips, sheets, plates, bolts, round wires, profile wires, round bars, profile bars, hollow bars, pipes and profiles from a tin-containing copper alloy as claimed in claim 1 with the aid of a permanent mold casting process or a continuous or semicontinuous strand casting process.

11. The process as claimed in claim 10, wherein a further processing of a cast state comprises the performance of at least one hot forming operation within the temperature range from 600 to 880° C.

12. The process as claimed in claim 9, wherein at least one annealing treatment is conducted within the temperature range from 200 to 880° C. for a duration of 10 minutes to 6 hours.

13. The process as claimed in claim 10, wherein a further processing of a cast state or of a hot-formed state or of an annealed cast state or of an annealed hot-formed state comprises the performance of at least one cold forming operation.

14. The process as claimed in claim 13, wherein at least one annealing treatment is conducted within the temperature range from 200 to 880° C. for a duration of 10 minutes to 6 hours.

15. The process as claimed in claim 13, wherein a stress relief annealing/age annealing operation is conducted within the temperature range from 200 to 650° C. for a duration of 0.5 to 6 hours.

16. Adjustment gibs and sliding gibs, friction rings and friction disks, slide bearing faces in composite components, sliding elements and guide elements in internal combustion engines, valves, turbochargers, gears, exhaust gas aftertreatment systems, lever systems, braking systems and joint systems, hydraulic aggregates, and machines and installations in mechanical engineering, comprising the tin-containing copper alloy as claimed in claim 1.

17. Components, wire elements, guiding elements, and connection elements in electronics/electrical engineering, comprising the tin-containing copper alloy as claimed in claim 1.

18. Metallic articles in the breeding of seawater-dwelling organisms, percussion instruments, propellers, wings, marine propellers and hubs for shipbuilding, housings of water pumps, oil pumps and fuel pumps, guide wheels, runner wheels and paddle wheels for pumps and water turbines, gears, worm gears, helical gears, forcing nuts and spindle nuts, and pipes, seals and connection bolts in the maritime and chemical industry, comprising the tin-containing copper alloy as claimed in claim 1.

* * * * *